US007614844B2

(12) United States Patent
Schofield

(10) Patent No.: US 7,614,844 B2
(45) Date of Patent: Nov. 10, 2009

(54) VACUUM PUMPING ARRANGEMENT

(75) Inventor: Nigel Paul Schofield, Horsham (GB)

(73) Assignee: Edwards Limited, Crawley, West Sussex (GB)

( * ) Notice: Subject to any disclaimer, the term of this patent is extended or adjusted under 35 U.S.C. 154(b) by 135 days.

(21) Appl. No.: 10/581,696

(22) PCT Filed: Dec. 8, 2004

(86) PCT No.: PCT/GB2004/005211

§ 371 (c)(1),
(2), (4) Date: Jun. 6, 2006

(87) PCT Pub. No.: WO2005/059367

PCT Pub. Date: Jun. 30, 2005

(65) Prior Publication Data

US 2007/0140833 A1 Jun. 21, 2007

(30) Foreign Application Priority Data

Dec. 15, 2003 (GB) ..... 0329034.3

(51) Int. Cl.
*F04D 19/04* (2006.01)

(52) U.S. Cl. ..... 415/90; 415/121.2

(58) Field of Classification Search ..... 415/55.6, 415/55.7, 90, 131, 157
See application file for complete search history.

(56) References Cited

U.S. PATENT DOCUMENTS 3,356,033 A 12/1967 Ullery
3,518,021 A 6/1970 Lake et al.
4,636,285 A * 1/1987 Tarumoto et al. ..... 205/195
5,137,418 A 8/1992 Sieghartner
2002/0018712 A1* 2/2002 Schofield ..... 415/121.2
2003/0077164 A1 4/2003 Moss
2003/0077187 A1* 4/2003 Kabasawa et al. ..... 417/322

FOREIGN PATENT DOCUMENTS

EP 1 065 383 A1 1/2001

OTHER PUBLICATIONS

United Kingdom Search Report of Application No. GB 0329034.3; Date of search: May 11, 2004.

PCT Notification of Transmittal of the International Search Report and the Written Opinion of the International Searching Authority, Or the Declaration of International Application No. PCT/GB2004/005211; Date of mailing: Mar. 15, 2005.

(Continued)

*Primary Examiner*—Edward Look
*Assistant Examiner*—Dwayne J White
(74) *Attorney, Agent, or Firm*—Mary Kristin Nicholes; Ting-Mao Chao

(57) ABSTRACT

A regenerative pumping mechanism comprises a rotor having a series of blades positioned in an annular array on one side of the rotor, and a stator having an annular channel within which the blades rotate. In order to control the axial clearance between the rotor and the stator, an axial magnetic bearing actively controls relative axial movement between the rotor and the stator. This can allow the pumping mechanism to provide controllable axial sealing between the rotor and the stator, as opposed to radial sealing.

27 Claims, 6 Drawing Sheets

OTHER PUBLICATIONS

PCT International Search Report of International Application No. PCT/ GB2004/005211; Date of mailing of International Search Report: Mar. 15, 2005.

PCT Written Opinion of the International Searching Authority of International Application No. PCT/GB2004/005211; Date of mailing: Mar. 15, 2005.

* cited by examiner

VACUUM PUMPING ARRANGEMENT

FIELD OF THE INVENTION

The invention relates to a vacuum pumping arrangement.

BACKGROUND OF THE INVENTION

With reference to FIGS. 1 and 2, from European patent publication no. 0,805,275, a compound vacuum pump is shown having a regenerative pumping mechanism 1 and a molecular drag (Holweck) mechanism 2. Mounted within the pump housing 3 between bearings 4, 5 is a shaft 6. The shaft 6 is adapted for rotation about its longitudinal axis and is driven by an electrical motor 7 surrounding the shaft 6.

The regenerative stage 1 comprises a rotor 9 mounted on the shaft 6. The rotor 9 is in the form of a circular disc, the lower surface of which presents a substantially flat surface on which are positioned integrally therewith a plurality (six) of raised rings 10, 11, 12, 13, 14, 15 situated symmetrically on the rotor about its centre point. Mounted on each of the raised rings is a series of equally spaced blades B, for example, one hundred blades on each ring to form concentric annular arrays of blades. The width of each ring, and the corresponding size of the blades on each ring, gradually decreases from the outermost ring 15 to the innermost ring 10. Each of the blades is slightly arcuate with the concave side pointing in the direction of travel of the rotor.

The body portion 16 of the housing 3 forms the stator and contains six circular channels in its upper surface which are of "keyhole" cross section and are of a size which closely accommodates in the rectangular section upper parts the six raised rings 10, 11, 12, 13, 14, 15; the circular section lower (as shown) parts accommodate the corresponding blades of the relevant raised ring. Each channel has a reduced cross sectional area (not shown) for a small part of its length of a shaped size substantially the same as that of the corresponding blades accommodated therein. This reduced cross sectional part of each channel forms the "stripper" which, in use, urges gas passing through that channel to be deflected by porting (not shown) in to the next (inner) channel until being exhausted from the pump via the bores 32, 33 in the body portion 16.

This arrangement allows for radial sealing between the rotor and stator of the regenerative mechanism. In this respect, the radial sealing occurs between the sides of the raised rings 10, 11, 12, 13, 14, 15 and the corresponding sides of the rectangular cross sectional part of the relevant channel, ie at 17, 18, especially the outermost sides 18, as shown in respect of the ring 10 only to aid clarity in the drawings, due to thermal expansion of the rotor 9 during use of the pump. However, in view of the close tolerances required to effect such radial sealing, any dust or other debris which might accumulate on the outermost sides of the channels 18 through the action of centrifugal forces could, if allowed to build up, cause the pump to seize.

The present invention seeks to solve this and other problems.

BRIEF SUMMARY OF THE INVENTION

In one aspect, the present invention provides a regenerative pumping mechanism comprising a rotor having a series of blades positioned in an annular array on one side of the rotor and extending axially into an annular channel of a stator within which the blades rotate, and means for actively controlling relative axial movement between the rotor and the stator so as to control the axial clearance between the rotor and the stator.

By controlling the axial clearance between the rotor and the stator, controllable axial sealing can be provided between the rotor and the stator. As a consequence, there is no longer any requirement to provide radial sealing, thereby avoiding the aforementioned problem associated therewith; any dust or debris in the pumped gases can migrate away under centrifugal forces rather than becoming trapped between any radial seals.

In a preferred embodiment, the means for actively controlling relative axial movement comprises an axial magnetic bearing for controlling axial movement of the rotor relative to the stator.

The axial magnetic bearing can comprise an electromagnet arranged to draw the rotor towards the stator, and thereby achieve accurate control of the axial clearance between the rotor and stator, typically to a precision less than 10 μm. To minimise pump length, the electromagnet may be conveniently mounted on the stator.

The electromagnet can be supplemented by a second electromagnet arranged to draw the rotor away from the stator, thereby improving control of the axial clearance. The axial magnetic bearing preferably comprises a magnetic bearing rotor, the magnetic bearing rotor and the rotor of the regenerative mechanism being located on a common shaft, the magnetic bearing rotor being located between the electromagnets. A control device may be arranged to control the strength of the magnetic field generated by the electromagnet (s) and thus the axial position of the rotor relative to the stator.

In an alternative embodiment, the means for actively controlling axial movement comprises an actuator, for example, a linear actuator, actuable to control the axial position of the rotor, for example, by moving a rolling bearing supporting the drive shaft. As the overall extent of the relative movement of the rotor and stator may be less than 50 μm, the actuator may conveniently comprise a magnetostrictive material, with a control device arranged to control the strength of a magnetic field applied to the actuator being provided, thereby accurately controlling the length of the actuator and thus the axial position of the rotor relative to the stator. Any other convenient mechanism for accurately moving the rotor relative to the stator may be provided. For example, a piezoelectric actuator may be provided, which deforms in response to a voltage supplied thereto by the control means to move the rotor relative to the stator. Alternatively, a metallic ring, tube or other element can be provided, which is selectively heated by the controller so that the resulting thermal expansion of the element causes the rotor to move relative to the stator. The most appropriate mechanism can be chosen for the extent of the required movement of the rotor relative to the stator.

In a preferred arrangement, the mechanism comprises means for detecting the axial position of the rotor relative to the stator and means for controlling the means for actively controlling relative axial movement in response to the detected position. A sensor may be provided for detecting the size, or the rate of change, of a clearance between the rotors and the stator. The sensor may be conveniently provided by a Hall effect sensor. The sensor can be calibrated by determining the position of the rotor when there is a predetermined axial clearance between the rotor and the stator. This can be achieved by moving the rotor axially until contact occurs (with the rotor non-rotational) either before use or once the pump has warmed up in order to account for thermal effects. Alternatively, these thermal effects can be built into the controller, so that they are taken into account when determining the size of the axial clearance from a signal output from the sensor.

A back-up bearing may be provided to limit the amount of relative movement between the rotor and the stator.

At least one of the rotor and the stator is formed from, or coated with, a wear-resistant, or self-lubricating, material to minimise damage in the event of contact between the rotor and the stator.

In a preferred embodiment, the rotor has at least two series of blades positioned in concentric annular arrays on the side of the rotor and the stator has a corresponding number of channels within which the blades of the arrays can rotate and means are provided to link the channels to form a continuous passageway through which fluid can pass.

As radial sealing can been dispensed with, a drive shaft for driving the mechanism may be supported at each end thereof by a lubricant free bearing, such as a magnetic bearing. Providing full magnetic support for the drive shaft had previously been difficult in view of the requirement for the radial running clearances for the radial seals to be less than 0.1 mm; typical back-up bearing clearances are greater than 0.15 mm.

The present invention also provides a pumping arrangement comprising a regenerative pumping mechanism as aforementioned. The arrangement may comprise means for controlling the axial clearance between the rotor and the stator and so control the pressure in a chamber connected to the pumping arrangement. For example, the axial clearance may be increased so that one or more of the stages of the pumping mechanism leak pumped fluid back to the previous stage. During roughing of the chamber, control of the axial clearance can allow a greater rate of fluid flow past the otherwise restrictive exhaust stages of the regenerative mechanism, thereby improving pumping speed.

Thus, in another aspect the present invention provides pumping arrangement for controlling pressure in a chamber, the arrangement comprising a regenerative pumping mechanism comprising a rotor having a series of blades positioned in an annular array on one side of the rotor, and a stator having an annular channel within which the blades rotate; and means for effecting axial movement of the rotor during use of the pump to control the axial clearance between the rotor and the stator and so control the pressure in the chamber.

BRIEF DESCRIPTION OF THE DRAWINGS

The present invention will now be described, by way of example only, with reference to the accompanying drawing, in which.

DETAILED DESCRIPTION OF THE INVENTION

Figure 3:
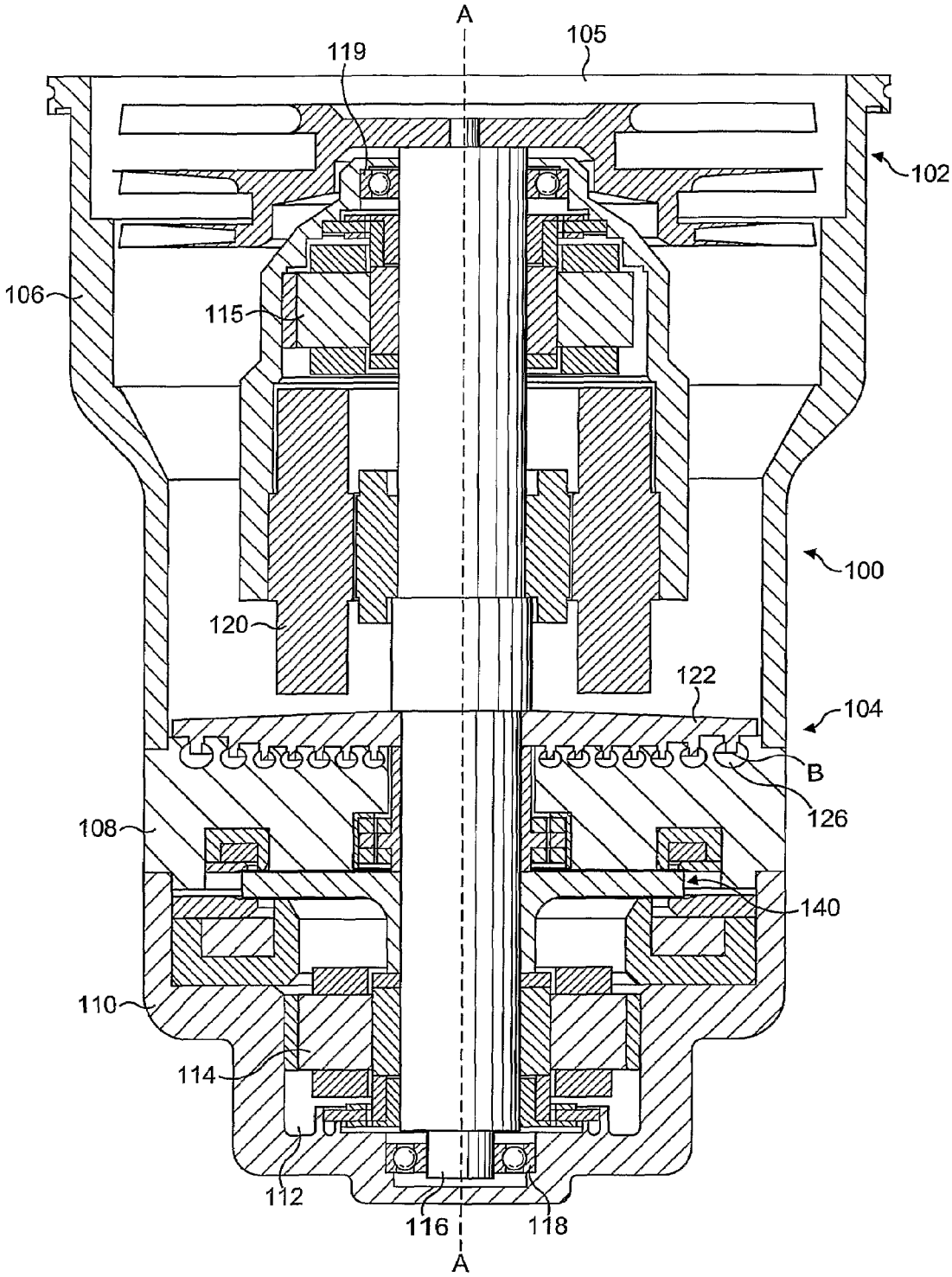
FIG. 3 is a sectional view of a vacuum pumping arrangement of the present invention.

With reference to FIG. 3, a vacuum pumping arrangement 100 comprises a molecular pumping mechanism 102, which may comprise one or both of a turbomolecular pumping mechanism and a molecular drag pumping mechanism, and a regenerative pumping mechanism 104. The inlet 105 of the pumping arrangement may be in fluid connection with a semiconductor processing chamber in which a clean environment is required. In use, gas in molecular flow conditions is drawn in through the inlet to the molecular pumping mechanism 102 which urges molecules into the regenerative pumping mechanism 104. Gas is exhausted at atmospheric pressure or thereabouts through an exhaust (not shown).

The pumping mechanisms are housed in a housing, which is formed in three separate parts 106, 108, 110. Part 106 forms the inner surfaces of the molecular pumping mechanism 102, and part 108 forms the stator of the regenerative pumping mechanism 104. Part 110 defines a recess 112 for receiving a radial magnetic bearing 114 for supporting one end of a drive shaft 116. The magnetic bearing 114 may be an active bearing, using electromagnets, or a passive bearing, using permanent magnets. A back-up bearing 118 may also provided to prevent excess radial movement of the shaft 116 in the event of, say, power failure. The other end of the drive shaft 116 is also supported by a radial magnetic bearing 115 and a back-up bearing 119.

Drive shaft 116 is driven by motor 120. The motor 120 may be supported at any convenient position in the vacuum pumping arrangement. The motor is adapted to be able to drive simultaneously the molecular pumping mechanism 102 and the regenerative pumping mechanism 104. As a regenerative pumping mechanism generally requires more power for operation than a molecular pumping mechanism lo in view of the regenerative pumping mechanism operating at pressures close to atmosphere where windage and air resistance is relatively high, the motor is selected for powering the regenerative pumping mechanism 104.

The regenerative pumping mechanism 104 comprises a stator 108 and a rotor 122. The stator has a plurality of linked circumferential pumping channels 124 disposed concentrically about the longitudinal axis A of the drive shaft 116. The rotor 124 is mounted to, or integral with, the drive shaft 116, and comprises a plurality of arrays of rotor blades B extending axially into respective circumferential pumping channels 126. In the embodiment shown in FIG. 3, the regenerative pumping mechanism 104 comprises seven pumping stages, for each stage a circumferential array of rotor blades B extending into a respective channel. During operation, the drive shaft 116 rotates the rotor 122, which causes the rotor blades B to travel along the pumping channels, pumping gas from an inlet (not shown), through each of the pumping stages in turn (from the outermost stage to the innermost stage) to an outlet (not shown) where the pumped gas is exhausted at a pressure close to or at atmospheric pressure.

Figure 4:
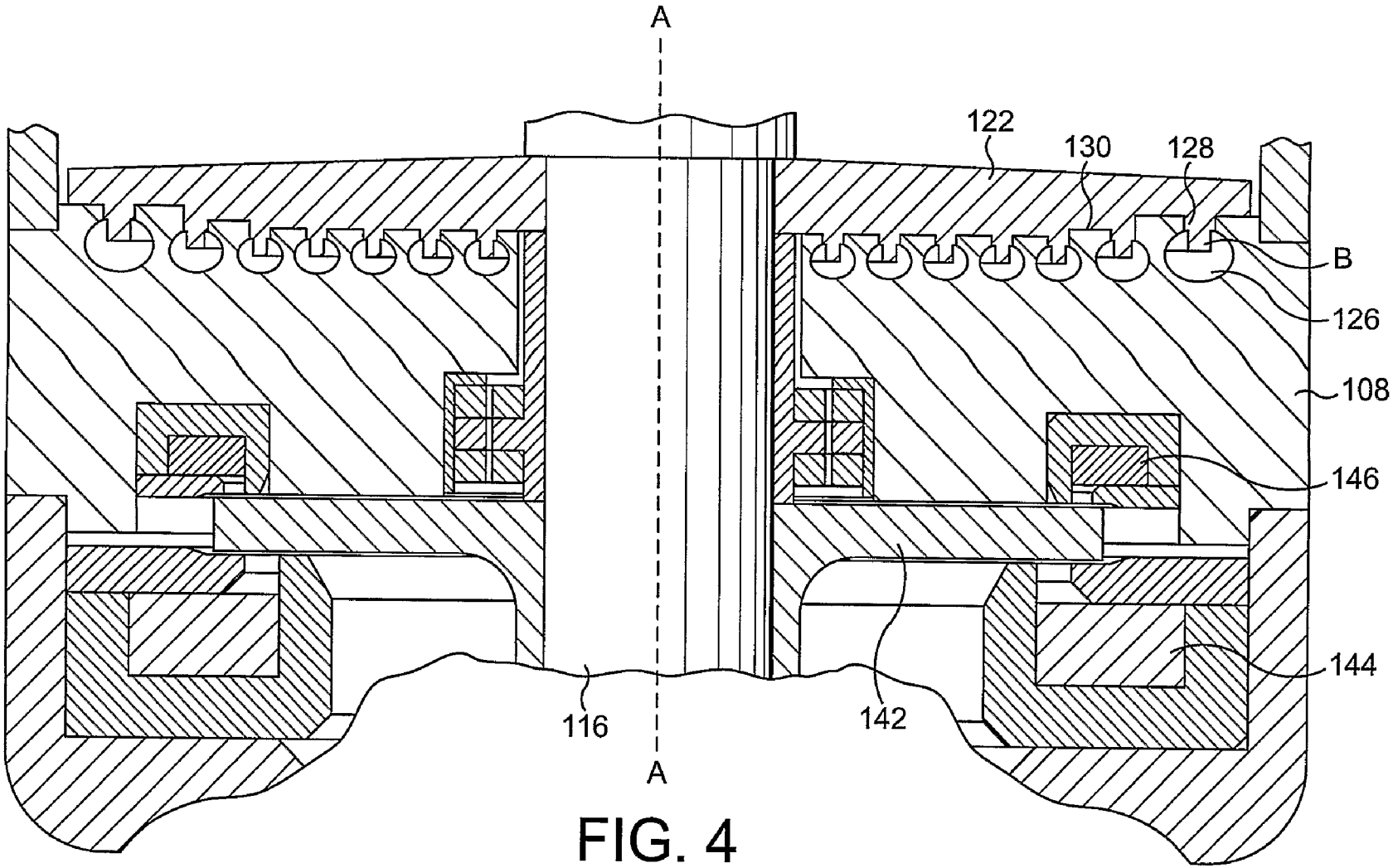
FIG. 4 is an enlarged sectional view of a portion of the representation shown in FIG. 3.

An enlarged cross-section of the regenerative pumping mechanism 104 is shown in FIG. 4. Each circumferential array of blades B is mounted on a respective raised ring 128 of the lower surface 130 of the rotor 122, the height of the raised rings 128 being much smaller than that of the raised rings 10, 11, 12, 13, 14, 15 of the prior regenerative mechanism 1 shown in FIG. 2. As known, each channel has a reduced cross sectional area (not shown) for a small part of its length of a shaped size substantially the same as that of the corresponding blades accommodated therein. This reduced cross sectional part of each channel forms the "stripper" which, in use, urges gas passing through that channel to be deflected by porting (not shown) in to the next (inner) channel until being exhausted from the pumping arrangement 100.

Figure 1:
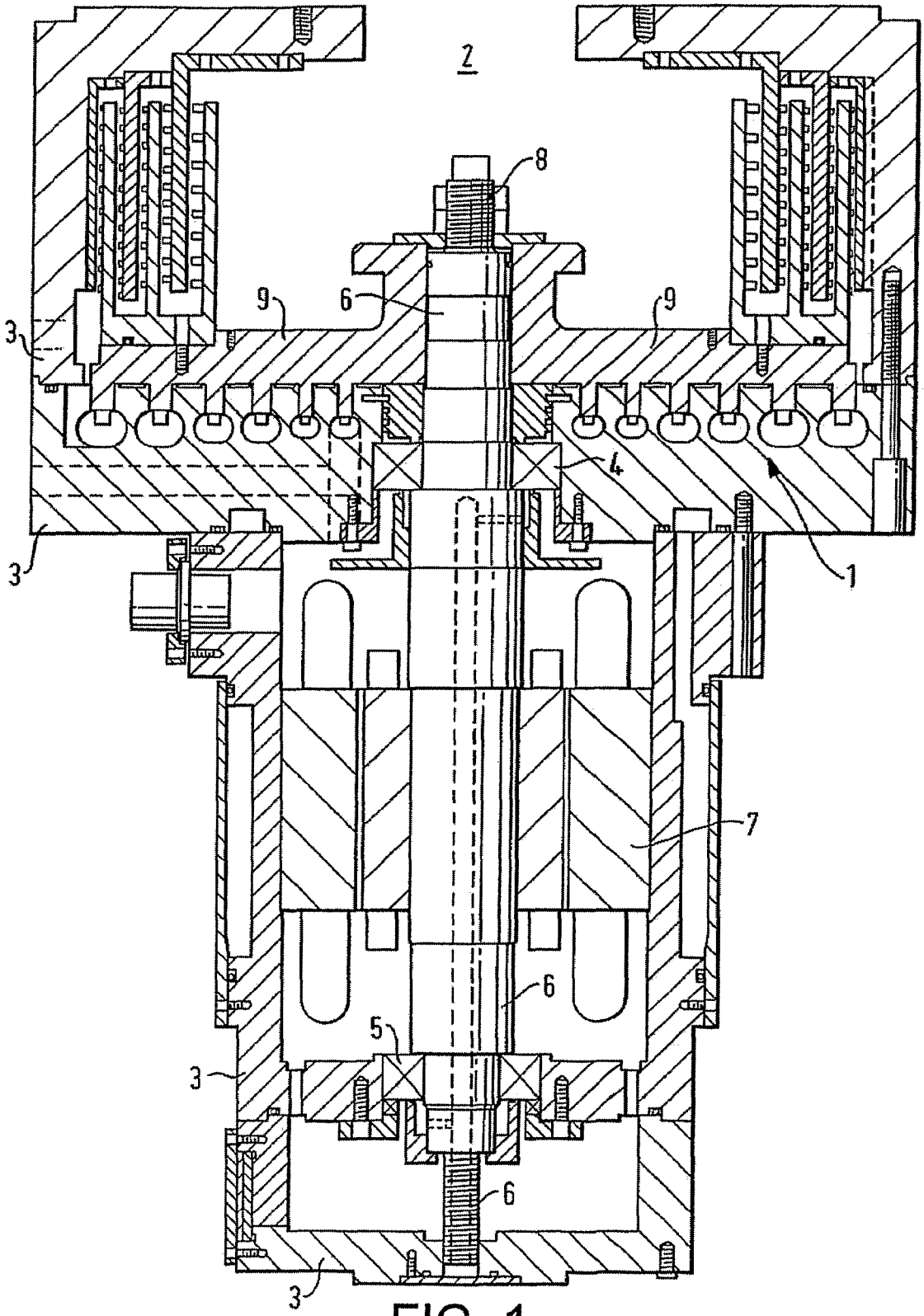
FIG. 1 (PRIOR ART)
FIG. 1 is a sectional view through a representation of a prior art vacuum pumping arrangement having both regenerative and Holweck stages.
Figure 2:
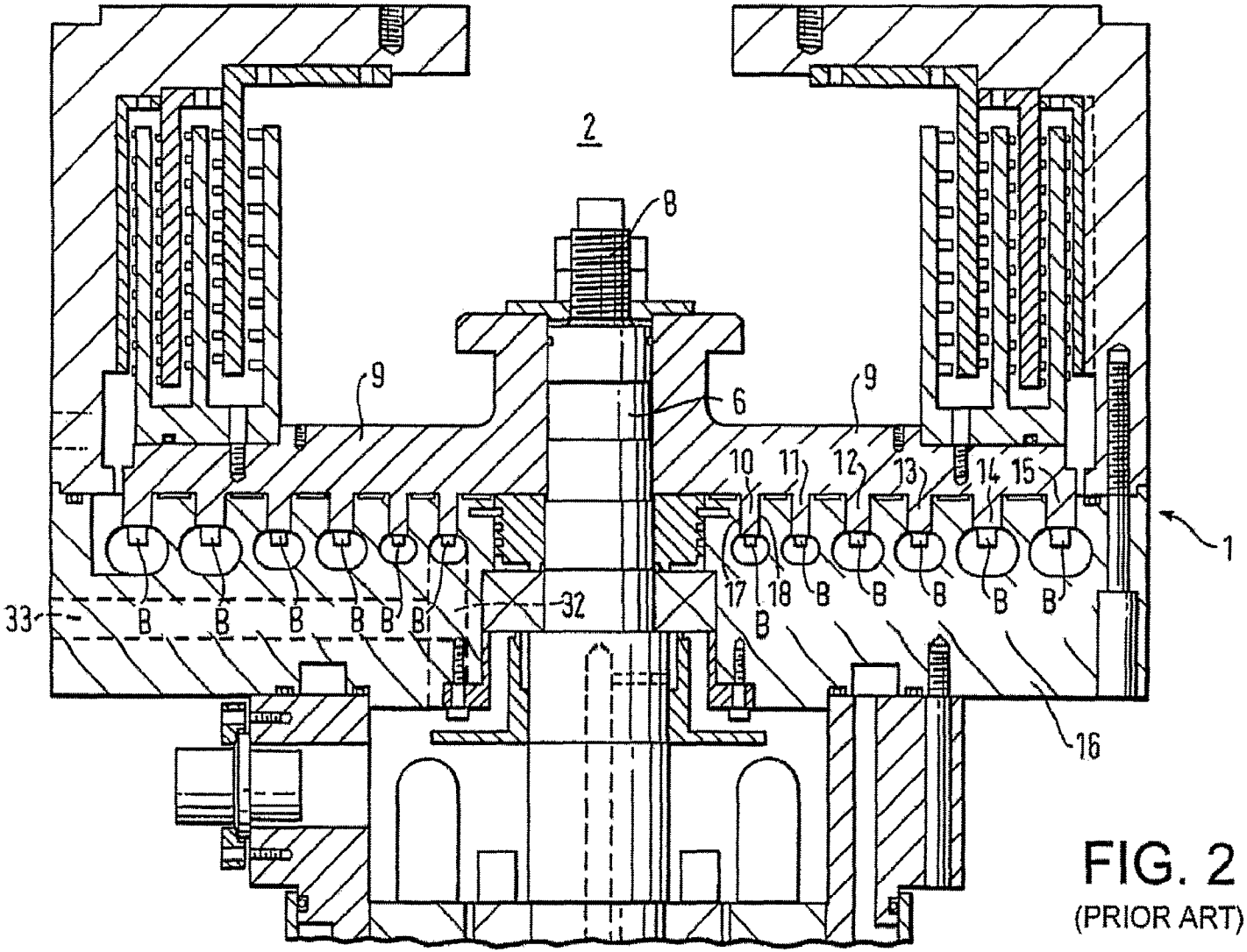
FIG. 2 (PRIOR ART)
FIG. 2 is an enlarged sectional view of a portion of the representation shown in FIG. 1.
Figure 5:
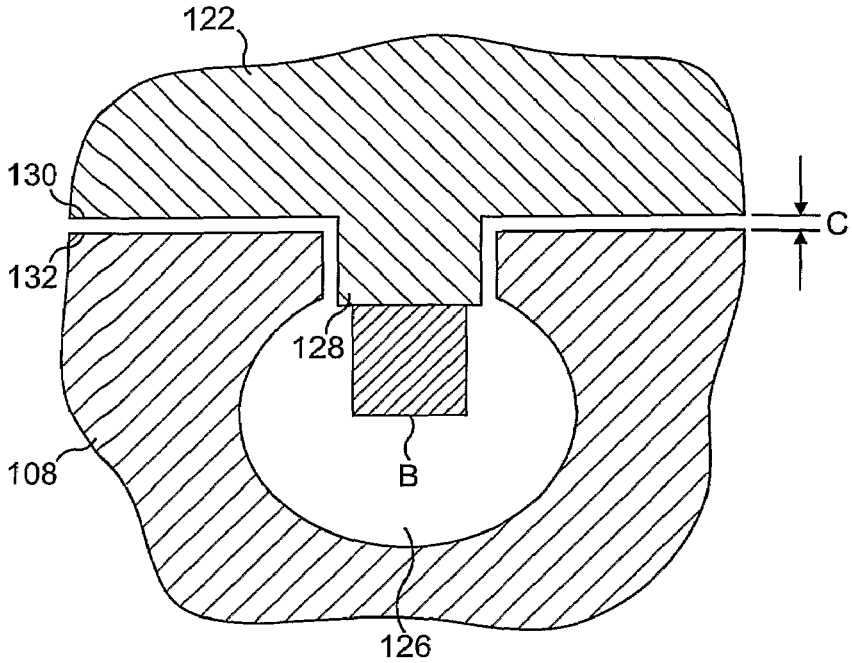
FIG. 5 is an enlarged section view of a pumping stage of the regenerative pumping mechanism of the pumping arrangement of FIG. 3.

In contrast to the regenerative pumping mechanism 1 of FIG. 2, the regenerative pumping mechanism 104 of the pumping arrangement 100 does not employ radial sealing between the rotor and stator, but instead relies on axial sealing. With reference to FIG. 5, for efficient operation of the regenerative pumping mechanism 104, it is important that the axial clearance "C" between the lower surface 130 of the rotor 122 and upper surface 132 of the stator 108 is closely controlled, and preferably kept to no more than 200 μm or less, and preferably less than 80 μm, during operation. An increase in clearance "C", for example, due the application by the pumped gas of an axial load on the rotor 122 tending to push the rotor 122 away from the stator 108, would lead to significant seepage of gas out of the pumping channels 126 and vary the pumping performance of the regenerative pumping mechanism 104.

Figure 6:
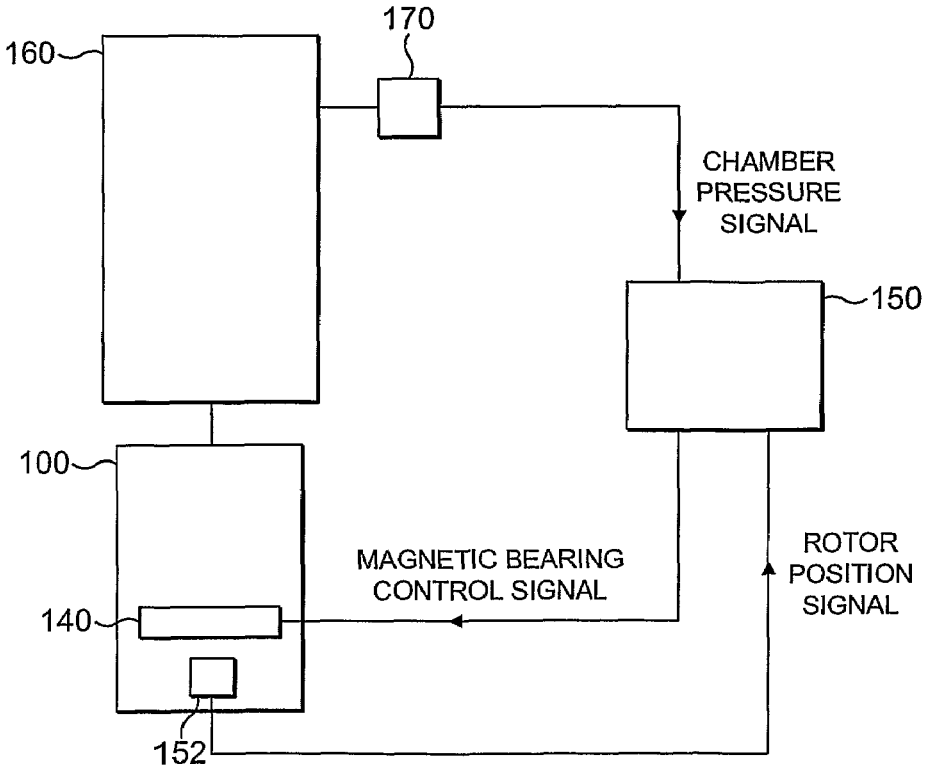
FIG. 6 illustrates a chamber pressure control mechanism.

In order to actively control the axial clearance C between the rotor 122 and the stator 108, and thus control the pumping performance, the pumping arrangement 100 includes an axial magnetic bearing 140. With reference to FIG. 4, the axial magnetic bearing 140 comprises a magnetic bearing rotor 142 mounted on, or integrally formed with, the drive shaft 116, the magnetic bearing rotor 142 being located between a first electromagnet 144 and a second electromagnet 146 mounted in the stator 108. Using a control device 150 (as shown in FIG. 6), the voltage applied to the electromagnets is selectively controlled to adjust the position of the magnetic bearing rotor 142 between the electromagnets 144,146, thereby controlling the axial position of the rotor 122 relative to the stator 108 and thus the size of the axial clearance C. In the arrangement shown in FIG. 4, increasing the voltage applied to the first electromagnet 144 tends to draw the rotor 122 towards the stator 108, whilst increasing the voltage applied to the second electromagnet 146 tends to draw the rotor 122 away from the stator 108.

A positional sensor 152 can be used to detect the axial position of the rotor 122 (or drive shaft 116) and output signals indicative of the position of the rotor 122 to the control device 150 to enable the magnitude of the voltages applied to the electromagnets 144, 146 to be varied as required to control the axial clearance C. Additionally, or alternatively, the pressure in the chamber 160 being evacuated by the pumping arrangement 100 can be measured using gauge 170, for example, a Pirani gauge. The gauge 170 outputs a signal indicative of the pressure in the chamber 160. This signal is fed into a control device 150, which uses the signal to provide a comparison between the current pressure in the chamber 160 and the desired pressure. Depending on the result of the comparison, the control device 150 can adjust the axial clearance C to control the rate of flow of fluid through the regenerative pumping mechanism (for example, by increasing the axial clearance C so that the pumped gas is caused to by-pass the stages of the regenerative pumping mechanism 104) and thereby adjust the pressure in the chamber 160. This can be particularly useful during roughing of the chamber 160 from atmospheric pressure, where increasing the axial clearance C can allow for an increased rate of fluid flow past the otherwise restrictive exhaust stages.

In the event that the rotor 122 and stator 108 come into contact, a combination of hard coatings and self-lubricating materials can be used for the surfaces 130, 132 of the rotor 122 and stator 108 to allow contact to occur without damage and only minimal wear.

In summary, a regenerative pumping mechanism comprises a rotor having a series of blades positioned in an annular array on one side of the rotor, and a stator having an annular channel within which the blades rotate. In order to control the axial clearance between the rotor and the stator, an axial magnetic bearing actively controls relative axial movement between the rotor and the stator.

This can allow the pumping mechanism to provide controllable axial sealing between the rotor and the stator, as opposed to radial sealing.

Figure 7:
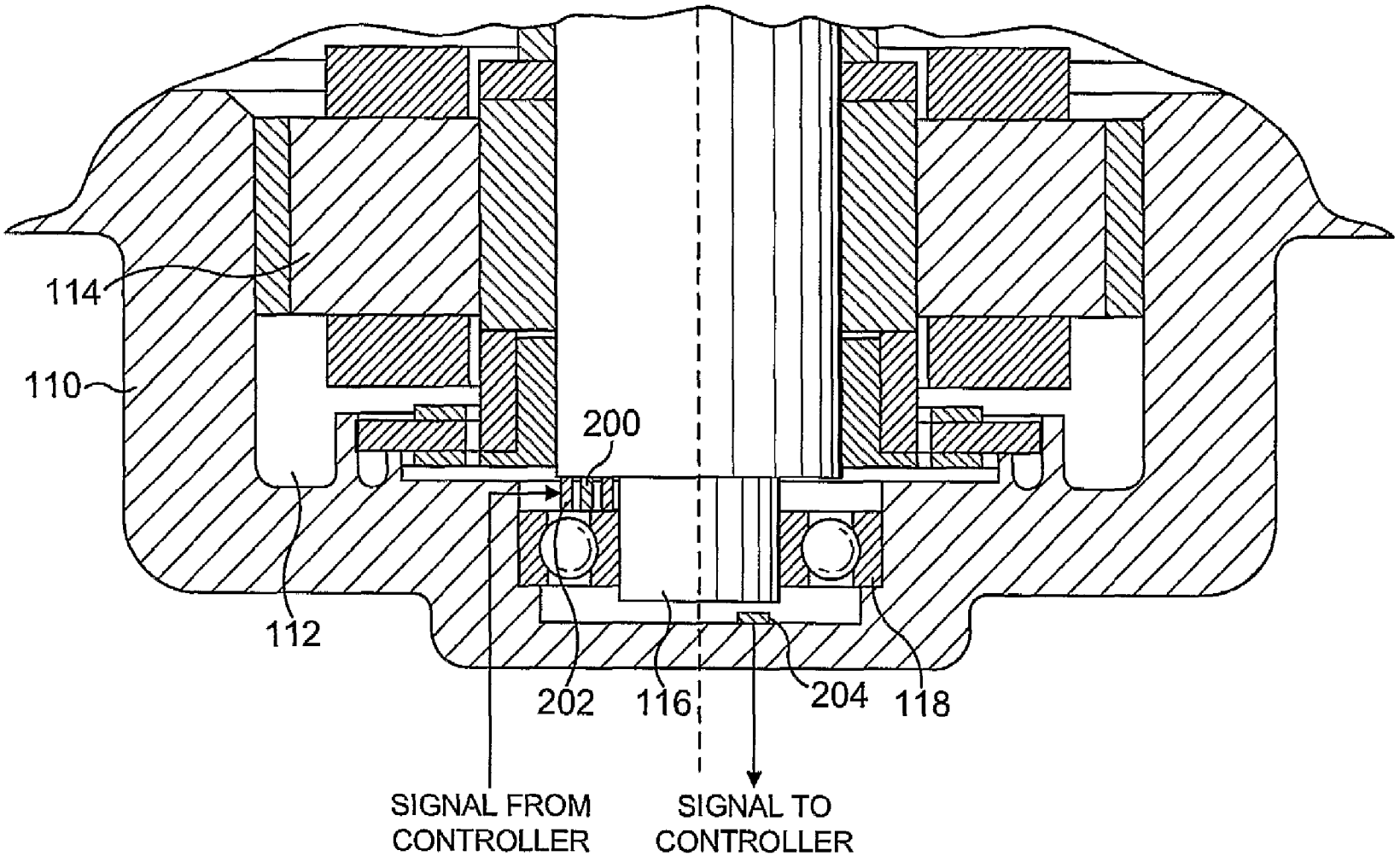
FIG. 7 is an enlarged sectional view of a lower portion the representation shown in FIG. 3.

For example, as an alternative to using a magnetic bearing to control movement of the rotor relative to the stator, or as a back-up in the event of a failure of the control of the magnetic bearing, FIG. 7 illustrates a linear actuator 200 may be used . . . The actuator may be located, for example, axially between the drive shaft 116 and back-up bearing 118, as shown in FIG. 7, and actuated to adjust the axial position of the drive shaft 116, for example by controlling the position of the bearing 118. The actuator may take any convenient form. For example, the actuator may be in the form of a linear actuator formed from magnetostrictive material, the length of which varies in relation to the strength of a magnetic field applied thereto by a surrounding electromagnet 202. The control device 150 may be configured to control the voltage supplied to this electromagnet in response to a signal output from sensor 152 indicative of an axial clearance between the drive shaft 116 and the stator in order to control the length of the actuator 200 and thus the axial position of the rotor relative to the stator.

Although the foregoing represents several embodiments of the invention, it will be understood by those skilled in the art that various changes in form and details may be made therein without departing from the scope of the invention as may be further defined by the claims appended hereto.

I claim:

1. A regenerative pumping mechanism comprising a rotor having a series of blades positioned in an annular array on one side of the rotor and extending axially into an annular channel of a stator within which the blades rotate, and means for actively controlling relative axial movement between the rotor and the stator so as to control the axial clearance between the rotor and the stator wherein the means for actively controlling relative axial movement comprises an axial magnetic bearing having an electromagnet arranged to draw the rotor towards the stator; and wherein the electromagnet is mounted on the stator of the regenerative pumping mechanism.

2. The mechanism according to claim 1 wherein the electromagnet is integrally mounted in the stator of the regenerative pumping mechanism.

3. The mechanism according to claim 1 wherein the axial magnetic bearing comprises a second electromagnet arranged to draw the rotor away from the stator.

4. The mechanism according to claim 3 wherein the axial magnetic bearing comprises a magnetic bearing rotor, and the magnetic bearing rotor and the rotor of the regenerative mechanism are positioned on a common shaft, and wherein the magnetic bearing rotor is positioned between the first and second electromagnets.

5. The mechanism according to claim 1 comprising control means for controlling the strength of the magnetic field generated by the electromagnet.

6. The mechanism according to claim 5 wherein the control means comprises means for detecting the axial position of the rotor relative to the stator.

7. The mechanism according to claim 1 wherein the means for actively controlling axial movement comprises an actuator actuable to control the axial position of the rotor.

8. The mechanism according to claim 7 wherein the actuator comprises a magnetostrictive material.

9. The mechanism according to claim 8 comprising control means for controlling the strength of a magnetic field applied to the actuator to control the shape of the actuator so as to control the axial position of the rotor relative to the stator.

10. The mechanism according to claim 7 comprising control means for controlling actuation of the actuator so as to control the axial position of the rotor relative to the stator.

11. The mechanism according to claim 10 wherein the control means comprises means for detecting the axial position of the rotor relative to the stator.

12. The mechanism according to claim 1 comprising means for limiting the amount of relative movement between the rotor and the stator.

13. The mechanism according to claim 1 wherein at least one of the rotor and the stator comprises a wear-resistant material.

14. The mechanism according to claim 1 wherein the rotor has two series of blades positioned in concentric annular arrays on a side of the rotor and wherein the stator has a corresponding number of channels within which the blades of the arrays can rotates and further comprising a passageway connecting the channels through which fluid can pass.

15. The mechanism according to claim 1 comprising a drive shaft for driving the mechanism.

16. The mechanism according to claim 15 wherein the drive shaft is supported at each end thereof by a lubricant free bearing.

17. The mechanism according to claim 16 wherein each lubricant free bearing comprises a magnetic bearing.

18. The mechanism according to claim 15 wherein the drive shaft is supported at each end by a rolling bearing.

19. The mechanism according to claim 15 wherein the means for actively controlling relative axial movement is arranged to control axial movement of the drive shaft and so as to control the axial position of the rotor relative to the stator.

20. A regenerative pumping mechanism comprising:

a rotor having a series of blades positioned in an annular array on one side of the rotor and extending axially into an annular channel of a stator within which the blades rotate;

means for actively controlling relative axial movement between the rotor and the stator so as to control the axial clearance between the rotor and the stator; and a drive shaft for driving the mechanism wherein the drive shaft is supported at each end by a rolling bearing; and wherein the means for actively controlling relative axial movement is arranged to axially move at least one of said rolling bearing so as to control the axial position of the drive shaft.

21. A pumping arrangement comprising:

a regenerative pumping mechanism comprising a rotor having a series of blades positioned in an annular array on one side of the rotor and extending axially into an annular channel of a stator within which the blades rotate; and means for actively controlling relative axial movement between the rotor and the stator so as to control the axial clearance between the rotor and the stator wherein the means for actively controlling relative axial movement comprises an axial magnetic bearing having an electromagnet arranged to draw the rotor towards the stator; and wherein the electromagnet is mounted on the stator of the regenerative pumping mechanism.

22. A pumping arrangement for controlling pressure in a chamber, the arrangement comprising:

a regenerative pumping mechanism comprising:

a rotor having a series of blades positioned in an annular array on one side of the rotor, and a stator having an annular channel within which the blades rotate; and means for effecting relative axial movement between the rotor and the stator during use of the pump to control the axial clearance between the rotor and the stator and so control the pressure in the chamber wherein the means for effecting relative axial movement comprises an axial magnetic bearing having an electromagnet arranged to draw the rotor towards the stator; and wherein the electromagnet is mounted on the stator of the regenerative pumping mechanism.

23. The pumping arrangement according to claim 22 comprising a drive shaft for driving the mechanism, and wherein the means for actively controlling relative axial movement is arranged to control axial movement of the drive shaft so as to control the axial position of the rotor relative to the stator.

24. The pumping arrangement according to claim 23 wherein the means for effecting relative axial movement comprises an actuator actuable to control the axial position of the rotor relative to the stator.

25. The pumping arrangement according to claim 24 wherein the actuator is arranged to move a bearing for supporting the drive shaft.

26. The pumping arrangement according to claim 22 wherein the means for effecting relative axial movement comprises an actuator actuable to control the axial position of the rotor relative to the stator.

27. The pumping arrangement according to claim 26 wherein the actuator is arranged to move a bearing for supporting the drive shaft.

* * * * *